United States Patent [19]

Takada et al.

[11] 4,224,401

[45] Sep. 23, 1980

[54] SILVER HALIDE PHOTOGRAPHIC EMULSIONS AND IMAGE FORMING PROCESS

[75] Inventors: Shunji Takada; Yoshitaka Akimura; Hiroyuki Mifune; Nobuyuki Tsujino, all of Minami-ashigara, Japan

[73] Assignee: Fuji Photo Film Co., Ltd., Minami-ashigara, Japan

[21] Appl. No.: 967,546

[22] Filed: Dec. 7, 1978

Related U.S. Application Data

[63] Continuation-in-part of Ser. No. 804,484, Jun. 7, 1977, abandoned.

[30] Foreign Application Priority Data

Jun. 7, 1976 [JP] Japan ..... 51-66354
Aug. 11, 1976 [JP] Japan ..... 51-96341
Nov. 11, 1976 [JP] Japan ..... 51-135562

[51] Int. Cl.[2] ..... G03C 5/30

[52] U.S. Cl. ..... 430/437; 430/438; 430/439; 430/440; 430/448; 430/481; 430/482; 430/490; 430/567; 430/569

[58] Field of Search ..... 96/66 R, 95, 107; 430/437, 438, 439, 440, 448, 481, 482, 490, 567, 569

[56] References Cited

U.S. PATENT DOCUMENTS 3,730,727 5/1973 Olivares et al. ..... 96/95

*Primary Examiner*—Edward C. Kimlin
*Assistant Examiner*—Alfonso T. Suro Pico
*Attorney, Agent, or Firm*—Sughrue, Rothwell, Mion, Zinn and Macpeak

[57] ABSTRACT

A negative image silver halide photographic emulsion comprising substantially surface latent image type monodispersed silver bromide or silver iodobromide grains containing up to about 10 mol% silver iodide, wherein the average grain size of the silver halide grains is about 0.7 micron or less, with the silver halide photographic emulsion containing a binder in an amount of about 250 g or less per mol of silver halide and a compound represented by the following general formula (I):

$$R^1NHNHCOR^2 \quad (I)$$

wherein $R^1$ represents an aryl group and $R^2$ represents a hydrogen atom, a phenyl group or a straight or branched chain alkyl group having 1 to 3 carbon atoms; a silver halide photographic light-sensitive element comprising a support having thereon at least one layer of a negative image silver halide photographic emulsion comprising substantially surface latent image type monodispersed silver bromide or silver iodobromide grains containing up to about 10 mol% silver iodide, wherein the average grain size of the silver halide grains is about 0.7 micron or less, with the silver halide photographic emulsion containing a binder in an amount of about 250 g or less per mol of silver halide, and the silver halide photographic emulsion or at least one other hydrophilic colloid layer on the support containing a compound represented by the general formula (I) above; and an image forming process which comprises imagewise exposing to light the photographic light-sensitive material described above and developing the photographic light-sensitive material with a developing solution containing at least one dihydroxybenzene in an amount of about 0.05 mol/liter to about 0.5 mol/liter and about 0.15 mol/liter or more of sulfite ion and having a pH of about 11.0 to about 12.3 whereby a high contrast image is obtained wherein the amount of the compound of the formula (I) is $10^{-4}$ to $10^{-1}$ mol/molAg.

18 Claims, No Drawings

SILVER HALIDE PHOTOGRAPHIC EMULSIONS AND IMAGE FORMING PROCESS

CROSS-REFERENCE TO RELATED APPLICATION

This application is a continuation-in-part of application Ser. No. 804,484 filed June 7, 1977, now abandoned.

BACKGROUND OF THE INVENTION

1. Field of the Invention

The present invention relates to an image forming-process and, particularly, to an image forming process which has a photographic characteristic of providing a very contrasty negative image and which are suitable for reproduction of precise line drawings and an image forming process using the same.

2. Description of the Prior Art

A process which comprises adding hydrazine compounds to silver halide photographic emulsions to obtain a photographic characteristic of a contrasty negative image is described in U.S. Pat. No. 2,419,975. This patent discloses that a very contrasty photographic characteristic of a gamma ($\gamma$) of more than 10 is obtained when hydrazine compounds are added to silver bromochloride emulsions and the emulsions are developed using a developing solution having a pH of as high as 12.8. However, a strongly alkaline developing solution having a pH near 13 is unstable because it is easily oxidized by air and, consequently, it cannot be stored or used for a long period of time. Further, silver bromochloride emulsions generally have a low sensitivity and are unsuitable for uses where a high sensitivity is required.

The supercontrasty photographic characteristic of a gamma of more than 10, for either a negative image or a positive image, is very useful for photographic reproduction of halftone images or reproduction of line drawing images by means of dot images useful for printing plates. In the past, for such a purpose, a process which comprises using silver bromochloride photographic emulsions having a silver chloride content of more than 50 mol% and preferably more than 75 mol% and developing such with a hydroquinone developing solution having a very low sulfite ion concentration (generally, less than about 0.1 mol/liter) has been used. However, in this process, the developing solution is very unstable because it has a low sulfite ion concentration and, consequently, the developing solution cannot be stored for 3 days or more. Further, since silver bromochloride emulsions having a comparatively high silver chloride content are used in this process, a high sensitivity cannot be obtained.

Accordingly, the ability to obtain a supercontrasty photographic characteristic useful for reproduction of dot images or line drawings using high speed emulsions and stable developing solutions has been very much desired.

SUMMARY OF THE INVENTION

A first object of the present invention is to provide silver halide photographic emulsions having a photographic characteristic which is capable of providing a very contrasty negative image of a $\gamma$ of more than about 10 using a stable developing solution.

A second object of the present invention is to provide high speed silver halide photographic emulsions which have a photographic characteristic providing a very contrasty negative image of a $\gamma$ of more than about 10.

A third object of the present invention is to provide a process for forming photographic images having a photographic characteristic of a very contrasty negative image using a stable developing solution containing sulfite ion.

A fourth object of the present invention is to provide a photographic image forming process in which a photographic characteristic of a very contrasty negative image in a high sensitivity can be obtained.

A fifth object of the present invention is to provide a process for forming very contrasty negative photographic images with a low degree of fog.

These and other objects of the present invention in one embodiment are attained with a silver halide photographic emulsion comprising substantially surface latent image type monodispersed silver bromide or silver iodobromide grains having an average particle size of about 0.7 micron or less and in which the amount of silver iodide in the silver iodobromide grains is about 10 mol% or less of the silver halide and binder in an amount of about 250 g or less per mol of the silver halide, and a compound represented by the following general formula (I):

$$R^1NHNHCOR^2 \quad (I)$$

wherein $R^1$ represents a monocyclic or bicyclic aryl group and $R^2$ represents a hydrogen atom, a straight or branched chain alkyl group having 1 to 3 carbon atoms or a phenyl group.

In another embodiment of this invention, this invention provides a photographic light-sensitive material comprising a support having thereon at least one silver halide photographic emulsion layer comprising substantially surface latent image type silver bromide or silver iodobromide grains containing up to about 10 mol% silver iodide, wherein the average grain size of the silver halide grain is about 0.7 microns or less, with the silver halide photographic emulsion containing a binder in an amount of about 250 g or less per mol of silver halide, with the silver halide photographic emulsion layer or at least one other hydrophilic colloid layer on the support containing a compound represented by the general formula (I) above.

In an additional embodiment of this invention, this invention provides an image forming process which comprises imagewise exposing to light a photographic light-sensitive material as described above and developing the photographic light-sensitive material with a developing solution containing at least one dihydroxybenzene in an amount of about 0.05 mol/liter to about 0.5 mol/liter and about 0.15 mol/liter or more of sulfite ion and having a pH of about 11.0 to about 12.3 wherein the amount of the compound of the formula (I) is $10^{-4}$ to $10^{-1}$ mol/molAg.

DETAILED DESCRIPTION OF THE INVENTION

In the general formula (I) above, $R^1$ represents a monocyclic or bicyclic aryl group. A suitable example of a monocyclic aryl group for $R^1$ is a phenyl group and a suitable example of a bicyclic aryl group for $R^1$ is a naphthyl group. The aryl group may be substituted with one or more substituents which are not electron-attracting, such as alkyl groups having 1 to 20 carbon atoms (which may be straight or branched chained, e.g., methyl, ethyl, propyl, iso-propyl, n-butyl, iso-butyl, n-octyl, n-hexyl, tert-octyl, n-decyl, n-dodecyl, etc.), aralkyl groups having 1 to 3 carbon atoms in the alkyl moiety thereof (e.g., benzyl, phenethyl, etc.), alkoxy groups having 1 to 20 carbon atoms (in which the alkyl moiety may be straight or branched chain, e.g., methoxy, ethoxy, 2-methylpropyoxy, etc.), amino groups which are mono- or disubstituted with alkyl groups having 1 to 20 carbon atoms, aliphatic acylamino groups having 2 to 21 carbon atoms or aromatic acylamino groups (e.g., acetylamino, octynylamino, benzoylamino, dimethylamino, etc.), etc.

$R^2$ represents a hydrogen atom, an alkyl group having 1 to 3 carbon atoms which may be straight or branched chained (e.g., methyl, ethyl, n-propyl and iso-propyl) or a phenyl group. It is preferred for the alkyl group to be unsubstituted. The phenyl group may be substituted with one or more substituents which preferably are electron attracting groups such as a halogen atom (chlorine or bromine, etc.), a cyano group, a trifluoromethyl group, a carboxyl group or a sulfo group, etc.

Examples of suitable substituents represented by $R^1$ include a phenyl group, an $\alpha$-naphthyl group, a $\beta$-naphthyl group, a p-tolyl group, an m-tolyl group, an o-tolyl group, a p-methoxyphenyl group, an m-methoxyphenyl group, a p-dimethylaminophenyl group, a p-diethylaminophenyl group, a p-(acetylamino)phenyl group, a p-(caproylamino)phenyl group, a p-(benzoylamino)phenyl group and a p-benzylphenyl group, etc.

Examples of suitable substituents represented by $R^2$ other than a hydrogen atom include a methyl group, an ethyl group, an n-propyl group, an isopropyl group, a phenyl group, a 4-chlorophenyl group, a 4-bromophenyl group, a 3-chlorophenyl group, a 4-cyanophenyl group, a 4-carboxyphenyl group, a 4-sulfophenyl group, a 3,5-dichlorophenyl group and a 2,5-dichlorophenyl group.

Monocyclic aryl groups are preferred for $R^1$ and an unsubstituted phenyl group and a tolyl group are particularly preferred for $R^1$.

A hydrogen atom, a methyl group and phenyl groups which may be substituted are preferred for $R^2$. A hydrogen atom is particularly preferred for $R^2$.

Preferred compounds represented by the general formula (I) are those compounds represented by the following general formula (Ia):

$$R^1NHNHCOR^{12} \quad \text{(Ia)}$$

wherein $R^1$ has the same meaning as described in the general formula (I) and $R^{12}$ represents a hydrogen atom, a methyl group, an unsubstituted phenyl group or a phenyl group substituted with one or more electron attracting groups (e.g., as described above).

Particularly preferred compounds represented by the general formula (Ia) are those compounds represented by the general formula (Ib):

$$R^{11}NHNHCHO \quad \text{(Ib)}$$

wherein $R^{11}$ represents an unsubstituted phenyl group, a p-tolyl group or an m-tolyl group.

The above-described objects of the present invention concerning the image forming process are attained by imagewise exposing to light a photographic material comprising a support having thereon at least one silver halide photographic emulsion layer composed of substantially surface latent image type silver halide grains having an average particle size of about 0.7 micron or less in which the amount of silver iodide in the silver iodobromide grains is about 10 mol% or less and a binder in an amount of about 250 g or less per mol of silver halide, wherein the silver halide photographic emulsion layer or at least one of the other hydrophilic colloid layers present on the support contains a compound represented by the general formula (I) above, and developing the imagewise exposed photographic material using a developing solution containing at least one dihydroxybenzene in an amount of about 0.05 mol/liter to about 0.5 mol/liter and about 0.15 mol/liter or more of sulfite ion at a pH of about 11.0 to about 12.3 wherein the amount of the compound of the formula (I) is $10^{-4}$ to $10^{-1}$ mol/molAg.

In this embodiment of this invention, preferred compounds of the general formula (I) are the compounds of the general formula (Ia) described above and particularly preferred compounds of the general formula (I) are the compounds of the general formula (Ib) described above.

Further, a preferred dihydroxybenze used in this invention is hydroquinone.

The silver halide grains used in the present invention are substantially surface latent image type silver halide grains. In other words, the silver halide grains are not of the substantially internal latent type. The term "substantially surface latent image type" is used in the description of the present invention to describe the situation in which the sensitivity resulting from the following surface development (A) is higher than that resulting from the following internal development (B) when the emulsion is subjected to surface development (A) or internal development (B) after exposure to light for 1 to 0.01 second, wherein the sensitivity is defined by the following relationship:

$$S = 100/Eh$$

where S represents the sensitivity and Eh represents the amount of exposure necessary to obtain an average density:

$\frac{1}{2}(D_{max} + D_{min})$.

Surface Development (A)

The emulsion is developed at 20° C. for 10 minutes in a developing solution having the following composition.

| | |
|---|---|
| N-Methyl-p-aminophenol (hemisulfate) | 2.5 g |
| Ascrobic Acid | 10 g |
| Sodium Metaborate (tetrahydrate) | 35 g |
| Potassium Bromide | 1 g |
| Water to make | 1 l |

Internal Development (B)

The emulsion is processed at about 20° C. for 10 minutes in a bleaching solution containing 3 g/liter of potassium ferricyanide and 0.0125 g/liter of phenosafranine, washed with water for 10 minutes and developed at 20° C. for 10 minutes in a developing solution having the following composition.

| | |
|---|---|
| N-Methyl-p-aminophenol (hemisulfate) | 2.5 g |
| Ascorbic Acid | 10 g |
| Sodium Metaborate (tetrahydrate) | 35 g |
| Potassium Bromide | 1 g |
| Sodium Thiosulfate | 3 g |
| Water to make | 1 l |

If the emulsions of the present invention are not substantially surface latent image type emulsions, a positive image tends to be obtained as well as a negative image.

The average grain size of the silver halide grains used in the present invention should not be larger than about 0.7μ, preferably 0.4μ or less. The term "average grain size" is well known and is generally used by persons skilled in the silver halide photographic field. The grain size means the diameter of the grains in cases of grains which are spherical or nearly spherical. Where the particle is cubic, the grain size means the length of the edge$\times\sqrt{4/\pi}$. The average is calculated by an algebraic average or a geometric average based on a projected area of the particle. Details of calculations of the average grain size are described in C. E. K. Mees and T. H. James, *The Theory of the Photographic Process,* 3rd Ed., pages 36–43, Macmillan Co., New York (1966).

In the emulsions of the present invention, if the average grain size exceeds about 0.7 μ, a high contrast of a γ of more than about 10 cannot be obtained. It is further preferred for the average grain size of the silver halide grains in the emulsions of the present invention to be less than 0.4 μ. A characteristic of the emulsions of the present invention is a high sensitivity in spite of a small average grain size.

The silver halide which is used in this invention is silver bromide or silver iodobromide containing about 10 mol% or less silver iodide. With the silver iodobromide, it is further preferred for the silver iodide content to not exceed 6 mol%. The emulsions of the present invention are advantageous, because a remarkably higher sensitivity than in cases of silver bromochloride used in prior art lith-type supercontrasty sensitive materials is obtained by use of such a silver halide.

The emulsions of the present invention should not contain more than about 250 g of binder per mol of silver halide. A suitable amount of the binder can range from about 20 g to about 250 g per mol of silver halide. If the emulsions contain a binder in an amount of more than about 250 g per mol of silver halide, it is not possible to obtain a contrasty tone and, particularly, to obtain an extremely contrasty photographic characteristic of a γ of more than about 10 which is an object of the present invention. Although a general tendency for the photographic emulsions is that the lower is the amount of the binder in the emulsions, the more contrasty is the tone obtained, such a tendency is an effect based on the amount of silver halide included in an emulsion layer per unit thickness and unit area. The influence of the amount of silver halide in the present invention is different from that in known cases, and the influence upon gradation changes greatly in an amount near the above-described limit. This change is shown in Example 5 below. The effect of the present invention is only obtained when the average grain size does not exceed about 0.7μ and the amount of silver halide in the emulsion is high.

Although gelatin is generally and advantageously used as the binder or protective colloid for the photographic emulsions of this invention, other hydrophilic colloids may also be used in this invention. For example, it is possible to use proteins such as gelatin derivatives, graft polymers of gelatin with other high molecular weight materials, albumin or casein, etc., cellulose derivatives such as hydroxyethylcellulose, carboxymethylcellulose or cellulose sulfates, etc., saccharide derivatives such as sodium alginate or starch derivatives, etc., and synthetic hydrophilic high molecular weight materials such as homo- or copolymers such as polyvinyl alcohol, partially acetaled polyvinyl alcohol, poly-N-vinylpyrrolidone, polyacrylic acid, polymethacrylic acid, polyacrylamide, polyvinylimidazole or polyvinylpyrazole, etc.

Not only lime processed gelatin but also acid treated gelatin may be used as the gelatin. Further, gelatin hydrolysis products or enzymatic gelatin decomposition products may be used. Those gelatin derivatives which are produced by reacting gelatin with various compounds such as acid halides, acid anhydrides, isocyanates, bromoacetic acid, alkanesultones, vinylsulfonamides, maleinimide compounds, polyalkylene oxides or epoxy compounds, etc., may be used. Examples of these gelatin derivatives are described in, for example, U.S. Pat. Nos. 3,614,928, 3,132,945, 3,186,846 and 3,312,553, British Pat. Nos. 861,414, 1,033,189 and 1,005,784 and Japanese Patent Publication 26845/67.

As the above-described gelatin graft polymers, it is possible to use those produced by grafting gelatin with homo- or copolymers of vinyl monomers such as acrylic acid, metahcrylic acid, the esters thereof, the amides thereof, acrylonitrile or styrene, etc. Graft polymers prepared from polymers which are compatible with gelatin, such as polymers of acrylic acid, methacrylic acid, acrylamide, methacrylamide or hydroxyalkyl methacrylates, etc., are particularly preferred. Examples of graft polymers are described in U.S. Pat. Nos. 2,763,625, 2,831,767 and 2,956,884, etc. Typical synthetic hydrophilic high molecular weight materials are those described in German Patent Application (OLS) 2,312,708, U.S. Pat. Nos. 3,620,751 and 3,879,205 and Japanese Patent Publication 7561/68.

Although the silver halide emulsions used in the present invention need not necessarily be chemically sensitized, chemically sensitizied silver-halide emulsions are preferred. Processes for chemical sensitization of the silver halide emulsions which can be used include known sulfur sensitization, reduction sensitization and noble metal sensitization processes. These processes are described in references such as P. Glafkides, *Chimie et Phisique Photographique,* Paul Montel, Paris (1967) or Zelikmann, *Making and Coating Photographic Emulsions,* The Focal Press, London (1964) or H. Frieser, *Die Gründlagen der photographischen Prozesse mit Silberhalogeniden,* Akademische Verlagsgesellschaft, (1968). In the noble metal sensitization processes, a gold sensitization process is a typical process where gold compounds or mainly gold complexes are used. A reduction sensitization process may be used if the process does not generate a fog which causes practical difficulties.

Examples of sulfur sensitizing agents which can be used include not only sulfur compounds present in the gelatin per se but also various sulfur compounds such as thiosulfates, thioureas, thiazoles or rhodanines, etc. Examples of suitable sulfur compounds are described in U.S. Pat. Nos. 1,574,944, 2,410,689, 2,278,947, 2,278,668 and 3,656,955. Typical examples of reduction sensitizing agents which can be used include stannous salts, amines, formamidine sulfinic acid and silane compounds, etc., as described in U.S. Pat. Nos. 2,487,850, 2,518,698, 2,983,609, 2,983,610 and 2,694,637. Complex salts of Group VIII metals in the Periodic Table, such as platinum, iridium or palladium, etc., can be used for noble metal sensitization and examples thereof are described in U.S. Pat. No. 2,448,060 and British Pat. No. 618,061, etc.

Examples of specific compounds represented by the general formula (I) which can be used in this invention are shown below. The present invention, however, is not to be construed as being limited to these specific compounds.

1. 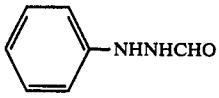

2. 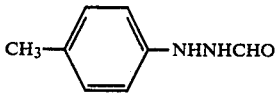

3. 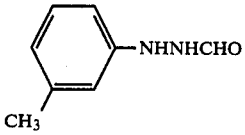

4. 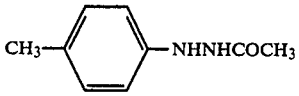

5. 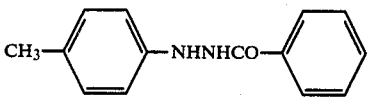

6. 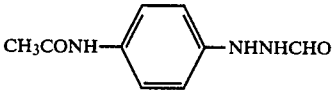

7. 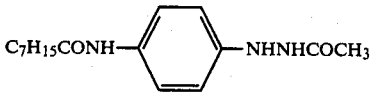

8. 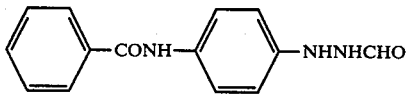

9. 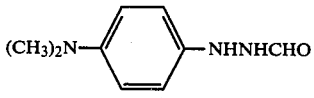

10. 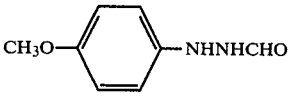

11. 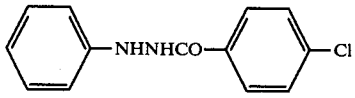

12. 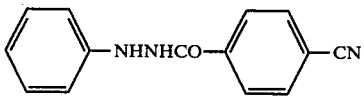

13. 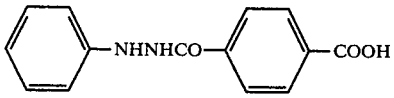

-continued

14. 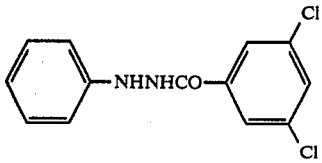

15. 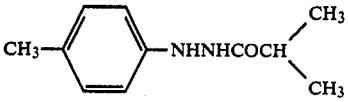

16. 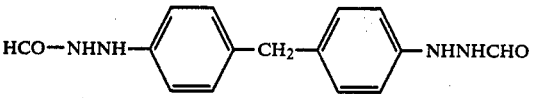

The compounds represented by the general formula (I) can be synthesized by reacting hydrazines with formic acid or by reacting hydrazines with acyl halides. Starting material hydrazines such as

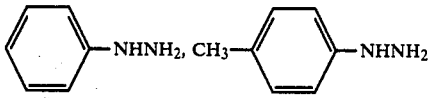

and

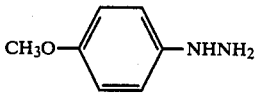

are commercially available and hydrazines of the formula

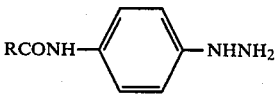

where R represents an alkyl group can be synthesized by reduction of a p-nitrophenylhydrazine. Suitable acyl halides which can be used include aliphatic acyl halides such as acetyl chloride, propionyl chloride, butyryl chloride, etc., and aromatic acyl halides such as benzoyl chloride, toluoyl chloride, etc. The reaction can be conducted in a solvent such as benzene, chloroform, pyridine, triethylamine, etc., and at a temperature of about 0° C. to about 100° C., preferably 0° C. to 70° C. A suitable molar ratio of the hydrazine to the acyl halide in the presence of a base such as pyridine or triethylamine which acts as a hydrogen halide acceptor for the hydrogen halide formed as a by-product ranges from about 1:1 to about 1:3, preferably 1:1.2 to 1:1.5 and in the absence of such a base ranges from about 1:0.3 to about 1:1, preferably 1:0.45 to 1:0.5. Hydrogen halide accepting agents such as triethylamine and pyridine can be employed in an amount of about one mol or more per mol of the acyl halide used.

Examples of synthesis of the compounds represented by the general formula (I) are described below. Unless otherwise indicated herein, all parts, percents, ratios and the like are by weight.

SYNTHESIS EXAMPLE 1

Synthesis of Compound 2

107 g of p-tolylhydrazine was added incrementally to 110 g of formic acid with stirring at 25° to 30° C. After the addition, the mixture was heated for 20 minutes with stirring at 50° C. After cooling with ice, the resulting crystals were separated by filtration and recrystallized from 550 ml of acetonitrile. Thus, 54.5 g of colorless needle-like crystals having a melting point of 176° C.-177° C. was obtained.

SYNTHESIS EXAMPLE 2

Synthesis of Compound 5

15 g of p-tolylhydrazine was added to 100 ml of acetonitrile at 25°-30° C. with stirring. 15 g of benzoyl chloride was then added dropwise at 25°-30° C. After the addition, stirring of the system was continued at 25°-30° C. for 6 hours. After cooling with ice, the resulting crystals were separated by filtration and recrystallized from benzene. Thus, 7 g of colorless needle-like crystals having a melting point of 146° C. was obtained.

The compounds represented by the general formula (I) are employed in the photographic emulsions of the present invention in an amount of about $10^{-4}$ to about $10^{-1}$ mol/mol Ag. A preferred amount is $10^{-3}$ to $5\times10^{-2}$ mol/mol Ag and particularly $5\times10^{-3}$ to $5\times10^{-2}$ mol/mol Ag.

The addition of the compound represented by the general formula (I) can be carried out using conventional methods of adding additives to photographic emulsions. For example, the compound can be added to the emulsions as an aqueous solution having a suitable concentration where the compound is water soluble or as a solution in an organic solvent compatible with water such as alcohols, ethers, glycols, ketones, esters or amides which do not adversely influence the photographic properties where the compound is insoluble or poorly soluble in water. Known methods similar to the addition of water insoluble couplers (the so-called oil soluble couplers) to emulsions as a dispersion can be used too.

The photographic emulsions of the present invention can be prepared by processes described in P. Glafkides, *Chimie et Physique Photographique,* Paul Montel Co., Paris (1967), G. F. Duffin, *Photographic Emulsion Chemistry,* The Focal Press, London (1966) and V. L. Zelikman et al., *Making and Coating Photographic Emulsions,* The Focal Press, London (1964). Namely, they may be prepared by any of an acid process, a neutral process or an ammonia process. Further, a single-jet process, a double-jet process or a combination thereof may be used as a process of reacting soluble silver salts with soluble halide salts.

A process of forming grains under conditions where an excess of silver ion (the so-called reverse mixing process) is present can also be used. One type of double-jet mixing process which can be used is a process which comprises holding the pAg constant in a liquid phase where silver halide is formed, namely, the so-called controlled double-jet process. According to this process, silver halide emulsions having a regular crystal form and a uniform grain size can be obtained.

The silver halide grains in the photographic emulsions of the present invention may have a comparatively wide grain size distribution. However, a narrow grain size distribution is preferred. It is particularly preferred for 90% by weight or number based on the total silver halide grains to have a grain size in a range of ±40% of the average grain size (generally, such an emulsion is called a monodispersed emulsion).

The silver halide grain in the photographic emulsions of the invention may have a regular form such as a cubic form or an octahedral form. Further, they may have an irregular crystal form such as that of a sphere or a plate, etc., or they may have a complex form of these crystal forms.

The silver halide grains may have a structure in which the inner part and the outer part are each composed of a different phase or may have a structure which is uniform throughout.

In forming silver halide grains or during physical ripening, cadmium salts, zinc salts, lead salts, thalium salts, iridium salts or complexes thereof, rhodium salts or complexes thereof, or iron salts or complexes thereof, etc., may also be present.

Two or more silver halide emulsions produced separately may be used by mixing them, if desired.

The soluble salts are generally removed from the emulsion after formation of the precipitates or after physical ripening. A well known noodle water washing process which is carried out after gelling of the gelatin may be used for this purpose. Further, flocculation processes utilizing inorganic salts containing a polyvalent anion, such as sodium sulfate, anionic surface active agents, anionic polymers (such as polystyrene sulfonic acid) or gelatin derivatives (such as aromatic acylated gelatins, aliphatic acylated gelatins or aromatic carbamoylated gelatins, etc.) can be used. The removal of the soluble salts may be omitted, if desired.

Although emulsions which are not -chemically sensitized (a so-called primitive emulsion) may be used as the silver halide emulsions, they are usually chemically sensitized.

If a small amount of iodide (for example, potassium iodide) is added to the emulsions after formation of the grains, before chemical ripening, after chemical ripening or before coating, the effect of the present invention is further increased. A preferred amount of iodide to be added is about $10^{-4}$ to about $10^{-2}$ mol/mol Ag.

The silver halide emulsions of the present invention may contain anti-fogging agents. Such emulsions are preferred in order to attain the objects of the present invention. Examples of preferred anti-fogging agents which can be used in the emulsions of the present invention include 1,2,3-triazole compounds, 3-mercapto substituted 1,2,4-triazole compounds, 2-mercaptobenzimidazole compounds (which should be unsubstituted with a nitro group), 2-mercaptopyrimidines, 2-mercaptobenzothiazoles, benzothiazolium compounds (for example, N-alkylbenzothiazolium halide or N-allylbenzothiazolium halide) and 2-mercapto-1,3,4-thiadiazoles, etc.

Particularly preferred anti-fogging agents for use in the present invention are benzotriazoles. The benzene ring thereof may be substituted with alkyl groups (for example, a methyl group or a heptyl group) or halogen atoms (for example, a chlorine atom or a bromine atom). The alkyl moiety of these substituents preferably has 12 or less carbon atoms and, particularly, 3 or less carbon atoms. Further, the 1-position of the benzotriazole may be substituted with a halogen atom (for example, a chlorine atom or a bromine atom).

In the benzotriazoles used in the present invention, preferred compounds are those represented by the following general formula (II):

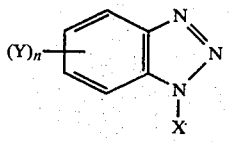

(II)

wherein Y represents an alkyl group having 1 to 12 carbon atoms (for example, a methyl group, a heptyl group or a decyl group), a halogen atom (for example, a chlorine atom or a bromine atom), an alkoxy group having 1 to 12 carbon atoms (for example, a methoxy group or a lauryloxy group), an acyl group having 2 to 13 carbon atoms (for example, an acetyl group or a benzyl group), an acylamino group having 2 to 13 carbon atoms (for example, an acetylamino group, a caproylamino group, a benzoylamino group or a benzenesulfonylamino group), a carbamoyl group which may be substituted with an aliphatic or aromatic group having up to 12 carbon atoms (for example, a methylcarbamoyl group or a phenylcarbamoyl group), a sulfamoyl group which may be substituted with an aliphatic or aromatic group having up to 12 carbon atoms (for example, a methylsulfamoyl group or a phenylsulfamoyl group) or a monocyclic or bicyclic aryl group (for example, a phenyl group). Y does not represent a nitro group. n represents 0, 1 or 2. Where n is 2, Y may be the same or different. The alkyl moiety in the Y group preferably has 1 to 3 carbon atoms. X represents a hydrogen atom, a halogen atom (for example, a chlorine atom or a bromine atom) or an acyl group having 1 to 10 carbon atoms (for example, an acetyl group or a propionyl group).

Examples of suitable compounds represented by the general formula (II) which can be used in this invention are described below. However, the present invention is not to be construed as being limited to these compounds.

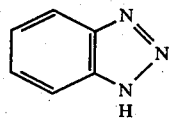

II-1

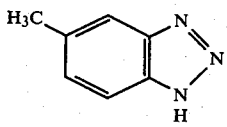

II-2

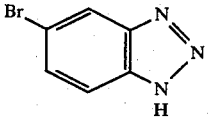

II-3

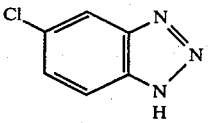

II-4

-continued

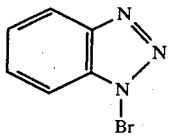

II-5

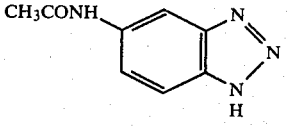

II-6

The benzotriazole compounds represented by the general formula (II) can be synthesized by reference to, for example, the disclosure in *Organic Synthesis,* Vol. 3, page 106; *Journal of the Chemical Society,* Vol. 119, pages 2088–94 (1921); *ibid.,* pages 1143–53 (1931) or ibid., Section C, pages 1474–78 (1969), etc.

In the image forming process of the present invention, it is advantageous for the development to be conducted in the presence of a benzotriazole compound in order to obtain images of a low degree of fog. The benzotriazole compound may be incorporated in the photographic material or may be added to the developing solution. Preferred benzotriazole compounds which can be used are those represented by the above-described general formula (II).

In the image forming process of the present invention, the benzotriazole compound may be incorporated, suitably, in one or more hydrophilic colloid layers of the photographic material. The benzotriazole compound may be incorporated in a light-sensitive emulsion layer or may be incorporated in a non-light-sensitive hydrophilic colloid layer. Where the benzotriazole compound is incorporated into a light-sensitive emulsion layer, although it is preferred for the emulsion layer to which such is added to be a silver halide emulsion layer essentially of the type used in the present invention, it may be incorporated into another type of silver halide emulsion layer. The benzotriazole compound may be incorporated into a single silver halide emulsion layer or may be incorporated into two or more silver halide emulsion layers. Where the benzotriazole compound is incorporated into a non-light-sensitive hydrophilic colloid layer, the layer may be any of an intermediate layer, a protective layer, a back layer and a layer between the silver halide emulsion layer and the support (under layer). The benzotriazole compound, however, is preferably incorporated into a layer adjacent the silver halide emulsion layer as used in the present invention.

In the image forming process of the present invention, the benzotriazole compound may be added to the developing solution. When the benzotriazole compound is added to the developing solution, it is added as a solution in a solvent compatible with water, such as an alcohol (for example, methanol or ethanol), a ketone (for example, acetone or methyl ethyl ketone) or an ester (for example, ethyl acetate) or as an aqueous solution during or after preparation of the developing solution. These solvents may be used, as desired, in an alkaline state or an acid state.

The photographic materials may be processed using a bath containing a benzotriazole compound before development and after exposure to light.

A preferred amount of the benzotriazole compound in the photographic emulsion ranges from about $10^{-4}$ to $10^{-1}$ mol/mol Ag. An amount of $10^{-3}$ to $3\times10^{-2}$ mol/mol Ag is particularly preferred.

Where the benzotriazole compound is incorporated into a non-light-sensitive hydrophilic colloid layer, a benzotriazole compound is preferably present in the above-described amount based on the amount of the silver salt in the same area.

Where the benzotriazole compound is added to the developing solution, an amount of about $10^{-6}$ to about $10^{-1}$ mol/liter of the developing solution is preferred, particularly an amount of $3\times10^{-5}$ to $3\times10^{-2}$ mol/liter of the developing solution is preferred.

The photographic emulsions of the present invention may be spectrally sensitized with methine dyes or the like. Examples of suitable dyes which can be used include cyanine dyes, merocyanine dyes, complex cyanine dyes, complex merocyanine dyes, holopolar cyanine dyes, hemicyanine dyes, styryl dyes and hemioxonol dyes. These dyes may contain nuclei commonly used as basic heterocyclic nuclei in cyanine dyes. Namely, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus or a pyridine nucleus; nuclei wherein an alicyclic hydrocarbon ring is fused to the above-described nuclei; and nuclei wherein an aromatic hydrocarbon ring is fused to the above-described nuclei, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus or a quinoline nucleus, etc., can be employed. These nuclei may be substituted with substituents on the carbon atoms thereof.

The merocyanine dyes or complex merocyanine dyes may contain 5- or 6-membered heterocyclic rings such as a pyrazolin-5-one nucleus, a thiohydantoin nucleus, a 2-thioxazolidin-2,4-dione nucleus, a thiazolidin-2,4-dione nucleus, a rhodanine nucleus or a thiobarbituric acid nucleus, etc.

Useful sensitizing dyes are those described in German Pat. No. 929,080, U.S. Pat. Nos. 2,231,658, 2,493,748, 2,503,776, 2,519,001, 2,912,329, 3,656,959, 3,672,897 and 3,694,217, British Pat. No. 1,242,588 and Japanese Patent Publication 14030/69.

These sensitizing dyes may be used individually or as a combination thereof. Combinations of sensitizing dyes are often used for the purpose of supersensitization. Typical examples of such combinations are described in U.S. Pat. Nos. 2,688,545, 2,977,229, 3,397,060, 3,522,052, 3,527,641, 3,617,293, 3,628,964, 3,666,480, 3,679,428, 3,703,377, 3,769,301, 3,814,609 and 3,837,862, British Pat. No. 1,344,281 and Japanese Patent Publication 4936/68.

The emulsions may contain dyes which do not have a spectral sensitization function themselves or materials which do not substantially absorb visible light but give rise to a supersensitization together with the sensitizing dyes. For example, aminostilbene compounds substituted with a nitrogen containing heterocyclic group (such as those described in; for example, U.S. Pat. Nos. 2,933,390 and 3,635,721), aromatic organic acid-formaldehyde condensation products (for example, those described in U.S. Pat. No. 3,743,510), cadmium salts and azaindene compounds may be employed. The combinations described in U.S. Pat. Nos. 3,615,613, 3,615,641, 3,617,295 and 3,635,721 are particularly useful.

The photographic emulsions of the present invention may contain water soluble dyes as filter dyes or for the purpose of preventing irradiation or for other purposes. Examples of such dyes include oxonol dyes, hemioxonol dyes, styreyl dyes, merocyanine dyes, cyanine dyes and azo dyes. Above all, oxonol dyes, hemioxonol dyes and merocyanine dyes are particularly preferred. Examples of these dyes which can be used include those described in British Pat. Nos. 584,609 and 1,177,429, Japanese Patent Applications (OPI) 85130/73, 99620/64 and 114420/64, and U.S. Pat. Nos. 2,274,782, 2,533,472, 2,956,879, 3,148,187, 3,177,078, 3,247,127, 3,540,887, 3,575,704, 3,653,905 and 3,718,472.

The photographic emulsions of the present invention may contain inorganic or organic hardening agents. For example, chromium salts (chrome alum or chromium acetate, etc.), aldehydes (formaldehyde, glyoxal or glutaraldehyde, etc.), N-methylol compounds (dimethylolurea or methyloldimethylhydantoin, etc.), dioxane derivatives (2,3-dihydroxydioxane, etc.), active vinyl compounds (1,3,5-triacryloylhexahydro-s-triazine or bis-(vinylsulfonyl) methyl ether, etc.), active halogen compounds (2,4-dichloro-6-hydroxy-s-triazine, etc.), mucohalic acids (mucochloric acid or mucophenoxychloric acid, etc.), isoxazoles, dialdehyde starch and 2-chloro-6-hydroxytriazinyl gelatin, etc., which may be used individually or in a combination of two or more thereof. Examples of suitable hardening agents include those described in U.S. Pat. Nos. 1,870,354, 2,080,019, 2,726,162, 2,870,013; 2,983,611, 2,992,109, 3,047,394, 3,057,723, 3,103,437, 3,321,313, 3,325,287, 3,362,827, 3,539,644 and 3,543,292, British Pat. Nos. 676,628, 825,544 and 1,270,578, German Pat. Nos. 872,153 and 1,090,427 and Japanese Patent Publications 7133/59 and 1872/71.

The photographic emulsions of the present invention may contain various known surface active agents for various purposes, e.g., as a coating aid, for preventing the generation of electrostatic charges, for improving lubricating properties, for emulsifying or dispersing, for preventing adhesion and for improving the photographic properties (for example, acceleration of development, hardening or sensitization), etc.

Examples of suitable surface active agents include nonionic surface active agents such as saponin (steroid type), alkylene oxide derivatives (for example, polyethylene glycol, polyethylene glycol-polypropylene glycol condensation products, polyethylene glycol alkyl or alkylaryl ethers, polyethylene glycol esters, polyethylene glycol sorbitan esters, polyalkylene glycol alkylamines or amides or polyethylene oxide addition products of silicones, etc.), glycidol derivatives (for example, alkenylsuccinic acid polyglycerides or alkylphenol polyglycerides), aliphatic acid esters of polyhydric alcohols, alkyl esters of saccharides, urethanes of saccharides or ethers of saccharides, etc.; anionic surface active agents containing acid groups such as a carboxyl group, a sulfo group, a phospho group, a sulfate group or a phosphate group, etc., such as triterpenoid type saponin, alkylcarboxylic acid salts, alkyl sulfonates, alkylbenzene sulfonates, alkylnaphthalene sulfonates, alkyl sulfates, alkyl phosphates, N-acyl-N-alkyltaurines, sulfosuccinic acid esters, sulfoalkylpolyoxyethylene alkylphenyl ethers or polyoxyethylene alkyl phosphoric acid esters, etc.; amphoteric surface active agents such as amino acids, aminoalkylsulfonic acids, aminoalkyl sulfates or phosphates, alkylbetaines, amine imides or amine oxides, etc.; and cationic surface active agents such as alkylamine salts, aliphatic or aromatic quaternary ammonium salts, heterocyclic quaternary ammonium salts such as pyridinium or imidazolidium salts, etc., or aliphatic or heterocyclic phosphonium or sulfonium salts, etc.

Examples of these surface active agents include those described in U.S. Pat. Nos. 2,240,472, 2,831,766, 3,158,484, 3,210,191, 3,294,540 and 3,507,660, British Patents 1,012,495, 1,022,878, 1,179,290 and 1,198,450, Japanese patent application (OPI) 117,414/75, U.S. Pat. Nos. 2,739,891, 2,823,123, 3,068,101, 3,415,649, 3,666,478 and 3,756,828, British Pat. No. 1,397,218, U.S. Pat. Nos. 3,133,816, 3,441,413, 3,475,174, 3,545,974, 3,726,683 and 3,843,368, Belgian Pat. No. 731,126, British Pat. Nos. 1,138,514, 1,159,825 and 1,374,780, Japanese Patent Publications 378/65, 379/65 and 13822/68, U.S. Pat. Nos. 2,271,623, 2,288,226, 2,944,900, 3,253,919, 3,671,247, 3,772,021, 3,589,906, 3,666,478 and 3,754,924, German Patent Application (OLS) 1,961,638 and Japanese patent application (OPI) 59025/75.

The photographic emulsions of the present invention may contain an aqueous dispersion of water insoluble (or poorly soluble) synthetic polymers for the purpose of minimizing dimensional changes of the images to an extent which can be disregarded. Examples of polymers which can be used include polymers composed of one or more of an alkyl acrylate or methacrylate, alkoxyalkyl acrylate or methacrylate, glycidyl acrylate or methacrylate, acryl or methacrylamide, vinyl esters (for example, vinyl acetate), acrylonitrile, olefins and styrene, etc., and polymers comprising a combination of the above-described monomers and acrylic acid, methacrylic acid, $\alpha,\beta$-unsaturated dicarboxylic acids, hydroxyalkyl acrylate or methacrylate or styrenesulfonic acid, etc. For example, the polymers described in U.S. Pat. Nos. 2,376,005, 2,739,137, 2,853,457, 2,062,674, 3,411,911, 3,488,708, 3,525,620, 3,607,290, 3,635,715 and 3,645,740, and British Pat. Nos. 1,186,699 and 1,307,373 can be used. A suitable amount of the polymer ranges from about 20 to 80% by weight based on the total weight of the binders. The contrasty emulsions as in the present invention are suitable for reproduction of line images. Accordingly, since dimensional stability is important in such a use, the emulsion preferably contains such a polymer dispersion in the present invention.

The photographic emulsions are coated on conventional supports which do not undergo serious dimensional changes during processing. Typical supports which can be used are a cellulose acetate film, a polystyrene film, a polyethylene terephthalate film, a polycarbonate film, a laminate thereof, paper, baryta paper, paper coated or laminated with a hydrophobic polymer such as polyethylene, polypropylene, etc., as are commonly used for photographic light-sensitive materials. Transparent supports can be employed for certain end-uses of the light-sensitive material. Also, transparent supports may be colored by adding a dye or a pigment thereto as described in *J. SMPTE* 67, 296 (1958), etc.

Where adhesion between the support and the photographic emulsion layer(s) is insufficient, a subbing layer (an adhesive layer adhesive to both the support and the photographic emulsion layer(s)) is employed. Also, in order to improve the adhesion, the surface of the support may be subjected to a preliminary processing such as a corona discharge, irradiation with ultraviolet rays, flame treatment, etc. A suitable coating amount of silver is about 0.5 g/m$^2$ to about 10 g/m$^2$ of the support.

Various kinds of light sources such as a tungsten light, a halogen lamp, a mercury lamp, a xenon lamp, laser light, electron beams, or X-rays can be used for exposure. A suitable amount of exposure ranges from about $10^{-4}$ CMS to about $10^4$ CMS, preferably about $10^{-3}$ CMS to about $10^2$ CMS.

Any known process can be used for the photographic processing of the layers of the exposed photographic emulsion of the present invention. Known processing solutions can be used. The processing temperature is usually selected within the range of about 18° C. to about 50° C. But the temperature used may be lower than about 18° C. or higher than about 50° C. Any development processing for forming silver images (black-white photographic processing) may be used.

The developing solution used in carrying out black-white photographic processing of the photographic emulsions of the present invention may contain known developing agents. Developing agents which can be used include dihydroxybenzenes (for example, hydroquinone), 3-pyrazolidones such as 1-phenyl-3-pyrazolidone (not more then 0.06 mol/liter, preferably not more than 0.03 mol/liter), and aminophenols such as N-methyl-p-aminophenol (not more than 0.02 mol/liter, preferably not more than 0.01 mol/liter). The use of dihydroxybenzene alone is preferred in the present invention. Particularly the use of hydroquinone alone is preferred. Suitable amount of dihydroxybenzene (hydroquinone) is about 0.01 mol/liter to 0.8 mol/liter and is particularly 0.05 mol/liter to 0.5 mol/liter. The developing solution contains other known preservatives, alkali agents, pH buffer agents and anti-fogging agents in addition to the developing agents. Further, they may contain, if desired, solubilizing agents, toning agents, development accelerating agents, surface active agents, defoaming agents, sequestering agents, hardening agents or viscosity increasing agents, etc.

The photographic emulsions of the present invention are developed using a developing solution containing about 0.15 mol/liter or more, e.g., about 0.15 mol/liter to about 1.2 mol/liter, of sulfite ion, by which a $\gamma$ of about 10 or more can be obtained. Suitable sulfite compounds which can be used include sodium sulfite, sodium bi-sulfite, potassium sulfite and potassium meta bi-sulfite. A preferred pH for the developing solution is a pH of about 11 to about 12.3. If the pH exceeds about 12.3, the developing solution becomes unstable even though it has a high sulfite ion concentration, and thus it is impossible to maintain stable photographic characteristics after 3 or more days. Suitable alkaline materials which can be used to achieve this pH range include hydroxides (for example, sodium hydroxide, potassium hydroxide, etc.), carbonates (for example, sodium carbonate, potassium carbonate, etc.), etc. If the development is carried out in the presence of a benzotriazole compound, it becomes possible to further decrease the occurrence of fog.

Although a characteristic of the photographic emulsions of the present invention is that a $\gamma$ of about 10 or more can obtained, it is also possible to obtain a $\gamma$ of less then about 10 (for example, 6 to 8) by changing the silver halide composition, the thickness of the emulsion layers or the conditions of development. In such cases, it is also possible to obtain advantages such as a high sensitivity, a thin film thickness or stability of the developing solution, etc., which could not be obtained in the prior art. Accordingly, the photographic materials wherein the $\gamma$ after development does not exceed about 10 are also included in the scope of the present invention.

In conducting the development of the photographic emulsions of the present invention, a developing solution which contains fogging agents (agents for forming development nuclei) in an amount which would substantially cause fog is not used. This is because such a developing solution partially results in a positive image.

Those fixing solutions having a composition generally employed in the art can be used in the present invention. Not only thiosulfates and thiocyanates but also organic sulfur compounds known as fixing agents can be used as fixing agents in the present invention.

Suitable preferred examples of fixing agents which can be used in the fixing solution include water soluble thiosulfates such as sodium thiosulfate, potassium thiosulfate, ammonium thiosulfate, etc., water soluble thiocyanates such as sodium thiocyanate, potassium thiocyanate, ammonium thiocyanate, etc., water soluble organic diol fixing agents containing an oxygen atom or a sulfur atom such as 3-thia-1,5-pentanediol, 3,6-dithia-1,8-octanediol, 9-oxa-3,6,12,15-tetrathia-1,17-heptadecanediol, etc., water soluble sulfur containing organic dibasic acids and water soluble salts thereof such as ethylenebisthioglycollic acid and the sodium salt thereof, etc., imidazolidinethiones such as methylimidazolidinethione, etc. Further, the fixing agents described in L. F. A. Mason, *Photographic Processing Chemistry,* pages 187 to 188, Focal Press (1966) are also preferred.

Other processing solutions, e.g., a bleaching solution, a fixing solution, a stabilizing solution, etc., known in the art also may advantageously be used. These processing solutions may be used in combination, e.g., as a bleach-fixing solution, a fix-stabilizing solution or a bleach-fix-stabilizing solution.

Such solutions are well known in the art, and any of such known solutions are useful. A bleaching solution contains a silver oxidizing agent(s), e.g., water soluble ferricyanides, a simple water soluble ferric, cupric, cobaltic salt or a ceric salt, such as ceric sulfate, and complex salts of an alkali metal and polyvalent cations with an organic acid. Typical examples of polyvalent cations are ferric ions, cobaltic ions, cupric ions, etc. Typical examples of the organic acids are ethylenediaminetetraacetic acid, nitrilotriacetic acid, etc.

The following examples are given to illustrate the present invention in greater detail.

EXAMPLE 1

To an aqueous solution of gelatin held at 50° C., an aqueous solution of silver nitrate and an aqueous solution of potassium bromide were added at the same time over a 50 minute period while the pAg was kept at 7.9, by which a silver bromide emulsion having an average grain size of 0.25μ was produced. After the water soluble salts were removed from the resulting emulsion, sodium thiosulfate was added in an amount of 43 mg per mol of silver bromide and the emulsion was chemically ripened at 60° C. for 60 minutes. The resulting emulsion contained 120 g of gelatin per mol of silver bromide. The internal sensitivity of this emulsion was much lower than the surface sensitivity, and the internal sensitivity could be disregarded.

To the resulting silver halide emulsion, 5-methylbenzotriazole (anti-fogging agent) was added together with Compound 2 of the present invention in the amounts as shown in Table 1 below to produce various emulsions. After the hardening agent (sodium salt of 2-hydroxy-4,6-dichloro-1,3,5-triazine) was added to each emulsion, they were coated each on a cellulose triacetate film in an amount of 45 mg of silver per 100 $cm^2$ to produce five kinds of photographic materials. After each sample was exposed to light for 1 second through a light wedge, each sample was developed at 20° C. for 3 minutes using a developing solution having the following composition and then each sample was subjected to conventional processings.

| | |
|---|---|
| N-Methyl-p-aminophenol Hemisulfate | 5 g |
| Hydroquinone | 10 g |
| Sodium Sulfite (anhydrous) | 75 g |
| Sodium Metaborate (tetrahydrate) | 30 g |
| Potassium Hydroxide | 12 g |
| Water to make | 1 l |
| | (pH 11.5) |

The resulting photographic characteristics obtained are shown in Table 1. In Table, 1, the relative sensitivity is represented as a relative value of the reciprocal of the amount of exposure required to achieve an optical density of 2.0 above the fog density, with the sensitivity of Sample 1 being assumed to be 100.

Table 1

| Sample No. | Compound 2 (g/mol Ag) | Anti-Fogging Agent (g/mol Ag) | Photographic Characteristic: Relative Sensitivity | γ | Fog |
|---|---|---|---|---|---|
| 1 | — | — | 100 | 5.0 | 0.38 |
| 2 | 2.4 | — | 208 | 11.0 | 0.45 |
| 3 | 2.4 | 0.5 | 275 | >20* | 0.07 |
| 4 | 5.1 | — | 282 | 17.0 | 0.42 |
| 5 | 5.1 | 0.5 | 309 | >20* | 0.06 |

*A γ value of above 20 cannot be measured using adensitometer.

As is understood from the results in Table 1 above, a γ of above 10 and a high sensitivity can be obtained with the photographic emulsions of the present invention using a stable developing solution having a pH of 11.5 containing sulfite ion even though they are silver bromide emulsions.

EXAMPLE 2

A sulfur-sensitized silver bromide emulsion having an average grain size of 0.25μ was prepared in the same manner as in Example 1. Before coating, a compound represented by the general formula (I) of the present invention as shown in Table 2 below was added to the emulsion to produce emulsion samples. Further, 5-methylbenzotriazole in an amount of 0.5 g/mol Ag and 2-hydroxy-4,6-dichloro-1,3,5-triazine sodium salt (0.4 g/100 g gelatin) were added to each of the emulsions. The emulsions thus prepared were each coated in the same manner as in Example 1. After exposure to light for 1 second through a light wedge, each sample was developed at 20° C. for 3 minutes using a developing solution having the following composition and then was subjected to conventional photographic processings.

| | |
|---|---|
| N-Methyl-p-aminophenol (hemisulfate) | 5 g |
| Hydroquinone | 10 g |
| Sodium Sulfite (anhydrous) | 75 g |
| Sodium Metaborate (tetrahydrate) | 30 g |
| Potassium Hydroxide | 15 g |
| Water to make | 1 l |

-continued

| | |
|---|---|
| | (pH 12) |

The gamma of each sample was measured and the results obtained are shown in Table 2 below.

Table 2

| Compound | Amount (g/mol of AgBr) | γ |
|---|---|---|
| 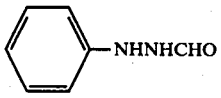 | 0.5<br>1.7<br>5.1 | 18<br>>20<br>>20 |
| 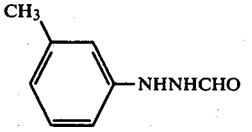 | 0.5 | >20 |
| 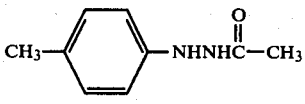 | 0.5<br>1.7<br>5.1 | 13<br>>20<br>>20 |
| 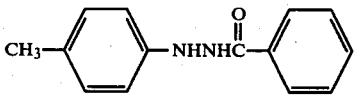 | 1.7<br>5.1 | 17<br>16 |
| 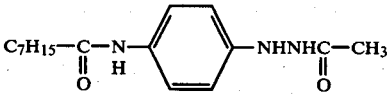 | 0.5<br>1.7 | >20<br>>20 |
| None | — | 5.0 |

EXAMPLE 3

The γ was measured in the same manner as in Example 2 except that hydrazine compounds other than those of the present invention as shown in Table 3 below were used in an amount of 5.1 g/mol of AgBr instead of the compounds represented by the general formula (I) as shown in Table 2. As a result, the γ of the samples containing the above-described compounds was not different from that of samples which did not contain such compounds (γ=5). On the contrary, N'—phenylformhydrazide of the present invention provided a γ of more than 20.

Table 3

| Compound | γ |
|---|---|
| $NH_2NH_2 \cdot 2HCl$ | 5.5 |
| 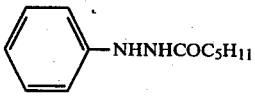 | 5.0 |
| 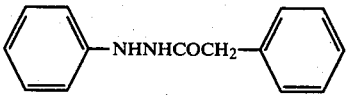 | 5.0 |
| 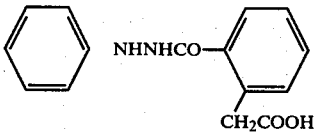 | 5.0 |

Table 3-continued

| Compound | γ |
|---|---|
| 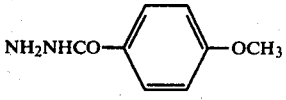 | 5.0 |
| 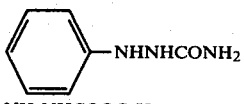 | 5.0 |
| $NH_2NHCOOC_2H_5$ | 4.0 |
| 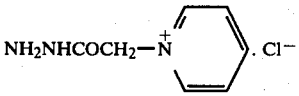 | 4.5 |
| 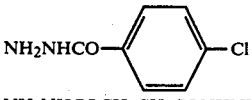 | 4.0 |
| $NH_2NHCOCH_2CH_2CONHNH_2$ | 5.0 |
| $NH_2NHCONHNH_2 \cdot HCl$ | 5.5 |
| $NH_2NHCONHCONHNH_2$ | 5.0 |

EXAMPLE 4

A silver iodobromide emulsion having an average grain size of 0.25μ and containing 2 mol% silver iodide and that containing 4 mol% silver iodide and a silver bromide emulsion having an average grain size of 0.5μ were prepared in the same manner as in Example 1. These emulsions are hereinafter designated Emulsions A, B and C. Chemical ripening was carried out in the same manner as in Example 1 except that the amount of sodium thiosulfate in Emulsion C was 26 mg/mol Ag. Emulsions A, B and C each contained 120 g of gelatin per mol of silver halide, and the internal sensitivity of which could be disregarded as compared to the surface sensitivity. Compound 2 of the present invention and 5-methylbenzotriazole as an anti-fogging agent were added to Emulsions A, B and C, as shown in Table 4 below. Coating, exposure and development were carried out in the same manner as in Example 1, and the photographic properties were measured. The results obtained are also shown in Table 4 below. The relative sensitivity shown was determined as in Example 1. Accordingly, the resulting values cannot be used for comparing the sensitivities of Emulsions A, B and C with each other.

Table 4

| Emulsion | Compound (g/mol Ag) | Anti-Fogging Agent (g/mol Ag) | Photographic Characteristics: Relative Sensitivity (Exposure of giving 1/D 2.0 | γ | Fog |
|---|---|---|---|---|---|
| Emulsion A | — | — | 100 | 5.6 | 0.22 |
| AgBrI I: 2 mol % | 2.4 | 0.5 | 224 | >20 | 0.06 |
| | 5.1 | 0.5 | 251 | >20 | 0.07 |
| Emulsion B | — | — | 100 | 5.2 | 0.30 |
| AgBrI I: 4 mol % | 2.4 | 0.5 | 269 | >20 | 0.07 |
| | 5.1 | 0.5 | 295 | >20 | 0.08 |
| Emulsion C | — | — | 100 | 5.6 | 0.23 |
| AgBr | — | 0.5 | 79 | 5.6 | 0.09 |
| | 1.7 | 0.5 | 282 | >20 | 0.08 |
| | 5.1 | 0.5 | 501 | >20 | 0.10 |

It can be understood from the results in Table 4 above that a $\gamma$ of above 20 can be obtained according to the present invention even though the silver iodobromide emulsions having an average grain size of 0.25$\mu$ and a silver bromide emulsion having an average grain size of 0.5$\mu$ are used.

EXAMPLE 5

To a silver bromide emulsion prepared in the same manner as in Example 1, a 10% solution of gelatin was added so that the ratio of gelatin to the silver halide was as follows:

| Emulsion | Gelatin/AgX Ratio (g/mol AgBr) |
|---|---|
| a | 155 |
| b | 205 |
| c | 310 |
| d | 410 |

To each emulsion, Compound 2 of the present invention was added in an amount of 2.4 g/mol of AgBr and 5-methylbenzotriazole was added in an amount of 0.7 g/mol of AgBr. Each emulsion was then coated, exposed to light and developed in the same manner as in Example 1. The resulting photographic properties obtained are shown in Table 5 below. The relative sensitivity is represented as a relative value by the reciprocal of the amount of exposure at which an optical density of 1.0 above the fog density was obtained.

Table 5

| | | Compound 2 Absent | | Compound 2 Present | |
|---|---|---|---|---|---|
| Emulsion | Gelatin (g/mol AgBr) | Relative Sensitivity | $\gamma$ | Relative Sensitivity | $\gamma$ |
| a | 155 | 100 | 4.0 | 173 | >20 |
| b | 205 | 97 | 4.0 | 138 | 13.0 |
| c | 310 | 95 | 3.9 | 110 | 7.1 |
| d | 410 | 95 | 3.8 | 100 | 5.3 |

EXAMPLE 6

To an aqueous solution of gelatin held at 50° C., an aqueous solution of silver nitrate and an aqueous solution of potassium bromide were added simultaneously over a 50 minute period while the pAg was held at 7.9, by which a silver bromide emulsion having an average grain size of 0.25$\mu$ was prepared. After the soluble salts were removed from the resulting emulsion, sodium thiosulfate was added in an amount of 43 mg per mol of silver bromide and the emulsion was chemically ripened at 60° C. for 60 minutes. The resulting emulsion contained 120 g of gelatin per mol of silver bromide. The internal sensitivity of this emulsion was much lower than the surface sensitivity, and could be disregarded.

To the resulting silver bromide emulsion, 5-methylbenzotriazole (anti-fogging agent) were added as shown in Table 6 below together with Compound 2 of the present invention to prepare various emulsions. Further, to each emulsion a 20 wt% dispersion of polyethyl acrylate produced according to the process described in British Pat. No. 1,186,699 was added in an amount of 17 cc per 100 g of gelatin and a hardening agent (2-hydroxy-4,6-dichloro-1,3,5-triazine sodium salt) was added in the amount of 0.4 g per 100 g of gelatin. Each of the emulsions were then coated on a cellulose triacetate film in the amount of 45 mg of silver content based on 100 cm$^2$ to produce five kinds of photographic materials. After each sample was exposed to light for 1 second through a light wedge, the sample was developed at 20° C. for 3 minutes using a developing solution having the following composition and the sample was then subjected to conventional processings.

| | |
|---|---|
| N-Methyl-p-aminophenol Hemisulfate | 5 g |
| Hydroquinone | 10 g |
| Sodium Sulfite (anhydrous) | 75 g |
| Sodium Metaborate (tetrahydrate) | 30 g |
| Potassium Hydroxide | 12 g |
| Water to make | 1 l |
| | (pH 11.5) |

The resulting photographic properties obtained are shown in Table 6 below. In Table 6, the relative sensitivity is represented as a relative value by the reciprocal of the amount of exposure at which an optical density of 2.0 above the fog density was obtained, which is shown relative to Sample 6 being 100.

Table 6

| | | Anti- | Photographic Characteristics | | |
|---|---|---|---|---|---|
| Sample No. | Compound (g/mol Ag) | Fogging Agent (g/mol Ag) | Relative Sensitivity | $\gamma$ | Fog |
| 6 | — | — | 100 | 4.8 | 0.38 |
| 7 | 2.4 | — | 205 | 10.8 | 0.43 |
| 8 | 2.4 | 0.5 | 273 | >20* | 0.07 |
| 9 | 5.1 | — | 280 | 17 | 0.40 |
| 10 | 5.1 | 0.5 | 307 | >20* | 0.06 |

*A $\gamma$ value of above 20 cannot be measured using a densitometer.

As can be understood from the results in Table 6, a $\gamma$ of above 10 and a high sensitivity can be obtained in the photographic emulsions of the present invention by using a stable developing solution having a pH of 11.5 containing sulfite ion even though they are silver bromide emulsions.

EXAMPLE 7

To an aqueous solution of gelatin at 50° C., an aqueous solution of silver nitrate and an aqueous solution of potassium bromide were added simultaneously over a 50 minute period while the pAg was kept at 7.9, by which a silver bromide emulsion having an average grain size of 0.25$\mu$ was produced. After the soluble salts were removed from the resulting emulsion, sodium thiosulfate was added in an amount of 43 mg per mol of silver bromide and the emulsion was chemically ripened at 60° C. for 60 minutes. The resulting emulsion contained 120 g of gelatin per mol of silver bromide. The internal sensitivity of this emulsion was much lower than the surface sensitivity and could be disregarded.

This silver bromide emulsion was divided into two parts. To one part, Compound 2 of the present invention was added in an amount of $2\times10^{-2}$ mol per mol of silver halide and a hardening agent (2-hydroxy-4,6-dichloro-1,3,5-triazine sodium salt) was added. To the other part, only the hardening agent was added. Each emulsion was coated on a polyethylene terephthalate film in an amount of 45 mg of silver per 100 cm$^2$. After exposure to light for 1 second through a light wedge, the samples were developed at 20° C. for 3 minutes using a developing solution having the following composition containing Compound II-1, II-2, II-3 or II-5 as used in the present invention and the samples were then subjected to conventional photographic processings. For comparison, samples which did not contain any compound of the general formula (II) were processed in the same manner.

| | |
|---|---|
| N-Methy-p-aminophenol Hemisulfate | 5 g |
| Hydroquinone | 10 g |
| Sodium Sulfite (anhydrous) | 75 g |
| Sodium Metaborate (tetrahydrate) | 30 g |
| Potassium Hydroxide | 12 g |
| Compound Represented by the General Formula (II) | shown in Table 7 |
| Water to make | 1 l (pH 11.5) |

The resulting photographic properties obtained are shown in Table 7 below. In Table 7, the relative sensitivity is represented as a relative value of the reciprocal of the amount of exposure required to obtain an optical density of 2.0 above the fog density, which is shown on the basis of the sensitivity of Sample 11 being 100.

Table 7

| Sample No. | Compound 2 | Compound of Formula (II) in Developing Solution: Compound Added | Amount of Compound Added (mol/l) | Photographic Characteristics: Relative Sensitivity | γ | Fog |
|---|---|---|---|---|---|---|
| 11 | Absent | — | — | 100 | 5 | 0.44 |
| 12 | Present | — | — | 204 | 15 | 0.52 |
| 13 | Absent | II-1 | $3.8 \times 10^{-3}$ | 87 | 5 | 0.04 |
| 14 | Present | " | " | 195 | 19 | 0.04 |
| 15 | Absent | II-2 | $3.4 \times 10^{-3}$ | 78 | 5 | 0.03 |
| 16 | Present | " | " | 182 | >20 | 0.03 |
| 17 | Absent | II-3 | $2.3 \times 10^{-3}$ | 72 | 5 | 0.03 |
| 18 | Present | " | " | 174 | >20 | 0.03 |
| 19 | Absent | II-5 | $2.3 \times 10^{-3}$ | 78 | 5.5 | 0.04 |
| 20 | Present | " | " | 170 | >20 | 0.03 |

It can be understood from the results in Table 7 above that images of high sensitivity, high γ and low fog are formed with the silver halide emulsion of the present invention containing a compound of the formula (I) used in the present invention with a compound of the formula (II).

EXAMPLE 8

A sulfur sensitized silver bromide emulsion having an average grain size of 0.25μ was prepared in the same manner as in Example 7. Before coating, compounds represented by the general formula (I) used in the present invention were added as shown in Table 8, and then 2-hydroxy-4,6-dichloro-1,3,5-triazine sodium salt (0.4 g/100 g of gelatin) was added to each emulsion. Each emulsion was coated in the same manner as in Example 7. After exposure to light for 1 second through a light wedge, each sample was developed at 20° C. for 3 minutes using a developing solution having the following composition and each sample was then subjected to conventional photographic processings.

| | |
|---|---|
| N-Methyl-p-aminophenol (hemisulfate) | 5 g |
| Hydroquinone | 10 g |
| Sodium Sulfite (anhydrous) | 75 g |
| Sodium Metaborate (tetrahydrate) | 30 g |
| Potassium Hydroxide | 15 g |
| Compound II-2 (1% solution in methanol) | 45 ml |
| Water to make | 1 l (pH 12) |

The resulting gammas obtained are shown in Table 8 below.

Table 8

| Compound | Amount (g/mol AgBr) | γ |
|---|---|---|
| 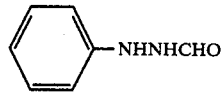 | 0.5 | 18 |
| | 1.7 | >20 |
| | 5.1 | >20 |
| 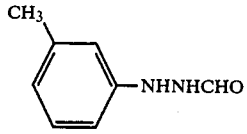 | 0.5 | >20 |
| 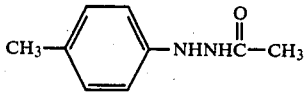 | 0.5 | 13 |
| | 1.7 | >20 |
| | 5.1 | >20 |
| | 1.7 | 17 |
| | 5.1 | 16 |
| 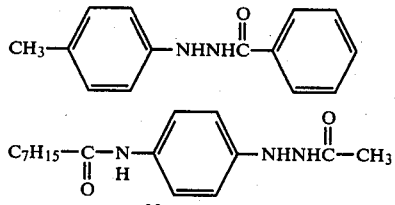 | 0.5 | >20 |
| | 1.7 | >20 |
| None | — | 5.0 |

While the invention has been described in detail and with reference to specific embodiments thereof, it will be apparent to one skilled in the art that various changes and modifications can be made therein without departing from the spirit and scope thereof.

What is claimed is:

1. An image forming process which comprises imagewise exposing to light a photographic light-sensitive material comprising a support having thereon at least one silver halide photographic emulsion layer comprising substantially surface latent image type monodispersed silver bromide or silver iodobromide grains containing up to about 10 mol% silver iodide, wherein the average grain size of said silver halide grains is about 0.7 micron or less and a binder in an amount of about 250 g or less per mol of silver halide, wherein said silver halide photographic emulsion layer or at least one other hydrophilic colloid layer on said support contains a compound represented by the general formula (I):

$$R^1NHNHCOR^2 \quad (I)$$

wherein $R^1$ represents an aryl group and $R^2$ represents a hydrogen atom, a phenyl group or an unsubstituted straight or branched chain alkyl group having 1 to 3 carbon atoms, and developing said photographic light-sensitive material with a developing solution containing, as a developing agent, a member selected from the group consisting of (a) dihydroxybenzene, (b) dihydroxybenzene plus aminophenol, (c) dihydrozybenzene plus 3-pyrazolidone and (d) dihydroxybenzene plus aminophenol plus 3-pyrazolidone, wherein said dihydroxybenzene is present in an amount of about 0.05 mol/liter to about 0.5 mol/liter, said 3-pyrazolidone is present in an amount of not more than 0.06 mol/liter and said aminophenol is present in an amount of not more than 0.02 mol/liter, and 0.15 mol/liter or more of sulfite ion and having a pH of about 11.01 to about 12.3, wherein the amount of the compound of the general formula (I) is $10^{-4}$ to $10^{-1}$ mol/mol Ag.

2. The image forming process as set forth in claim 1, wherein the development is carried out in the presence of at least one benzotriazole compound.

3. The image forming process as set forth in claim 2, wherein said benzotriazole compound is present in said developing solution.

4. The image forming process as set forth in claim 1, wherein said benzotriazole is present in said photographic emulsion layer.

5. The image forming process as set forth in claim 1, wherein said benzotriazole is present in one of said other hydrophilic colloid layers in said photographic sensitive material.

6. The image forming process as set forth in claim 1, wherein $R^2$ is a hydrogen atom, a methyl group, an ethyl group, an n-propyl group, an iso-propyl group, a phenyl group, a 4-chlorophenyl group, a 4-bromophenyl group, a 3-chlorophenyl group, a 4-cyanophenyl group, a 4-carboxyphenyl group, a 4-sulfophenyl group, a 3,5-dichlorophenyl group or a 2,5-dichlorophenyl group.

7. The image forming process as set forth in claim 1, wherein said silver halide photographic emulsion contains a compound represented by the formula:

$$R^1NHNHCOR^{12} \quad \text{(Ia)}$$

wherein R represents an aryl group and $R^{12}$ represents a hydrogen atom, a methyl group, an unsubstituted phenyl group or a phenyl group substituted with one or more electron attracting groups.

8. The image forming process as set forth in claim 1, wherein said silver halide photographic emulsion contains a compound represented by the formula:

$$R^{11}NHNHCHO \quad \text{(Ib)}$$

wherein $R^{11}$ represents an unsubstituted phenyl group, a p-tolyl group or an m-tolyl group.

9. The image forming process as set forth in claim 1, wherein said silver halide photographic emulsion additionally contains at least one water insoluble polymer dispersed therein.

10. The image forming process as set forth in claim 9, wherein said water insoluble polymer is a polymer composed of one or more of an alkyl acrylate or methacrylate, alkoxyalkyl acrylate or methacrylate, glycidyl acrylate or methacrylate, acryl or methacrylamide, vinyl ester, acrylonitrile, olefins and styrene; polymers comprising a combination said monomers and acrylic acid, methacrylic acid, $\alpha,\beta$-unsaturated dicarboxylic acid, hydroxyalkyl acrylate or methacrylate or styrenesulfonic acid.

11. The image forming process as set forth in claim 1, wherein said dihydroxybenzene is hydroquinone.

12. The image forming process as set forth in claim 1 wherein said developing solution contains a dihydroxybenzene developing agent as the sole developing agent.

13. The image forming process as set forth in claim 12 wherein said dihydroxybenzene is hydroquinone.

14. The image forming process as set forth in claim 1 wherein said developing solution further contains an aminophenyl developing agent and a 3-prazolidone developing agent.

15. The image forming process as set forth in claim 1 wherein the amount of compound represented by the formula (I) is $1\times10^{-3}$ to $5\times10^{-2}$ mol/mol Ag.

16. The image forming process as set forth in claim 1 wherein the amount of compound is $5\times10^{-3}$ to $5\times10^{-2}$ mol/mol Ag.

17. The image forming process as set forth in claim 1, wherein said 3-pyrazolidone is present in an amount of not more than 0.03 mol/liter.

18. The image forming process as set forth in claim 1, wherein said aminophenol is present in an amount of not more than 0.1 mol/liter.

* * * * *

UNITED STATES PATENT AND TRADEMARK OFFICE

CERTIFICATE OF CORRECTION

PATENT NO. : 4,224,401

DATED : September 23, 1980

INVENTOR(S) : Shunji Takada et al

It is certified that error appears in the above—identified patent and that said Letters Patent is hereby corrected as shown below:

Claim 1, line 32. Delete "11.01" and insert therefor --11.0--.

Claim 14, line 3. Delete "aminophenyl" and insert therefor --aminophenol--.

Claim 14, line 3. Delete "3-prazolidone" and insert therefor --3-pyrazolidone--.

Signed and Sealed this

*Fifteenth* Day of *June 1982*

[SEAL]

*Attest:*

GERALD J. MOSSINGHOFF

*Attesting Officer*

*Commissioner of Patents and Trademarks*

Notice of Adverse Decision in Interference

In Interference No. 100,740, involving Patent No. 4,224,401, S. Takada, Y. Akimura, H. Mifune and N. Tsujino, SILVER HALIDE PHOTOGRAPHIC EMULSIONS AND IMAGE FORMING PROCESS, final judgment adverse to the patentees was rendered Dec. 18, 1985, as to claims 1–3, 8, 11 & 14–17.

[*Official Gazette July 15, 1986.*]